United States Patent [19]

Barnowski

[11] 4,435,859

[45] Mar. 13, 1984

[54] TOILET FLUSH TANK

[76] Inventor: Reinhard Barnowski, Hauptstrasse 252, 5163 Langerwehe, Fed. Rep. of Germany

[21] Appl. No.: 350,026

[22] Filed: Feb. 18, 1982

[30] Foreign Application Priority Data

Feb. 24, 1981 [DE] Fed. Rep. of Germany ..... 3106764

[51] Int. Cl.[3] ..... E03D 1/14; E03D 3/12

[52] U.S. Cl. ..... 4/324; 4/390; 4/391; 4/397; 4/405

[58] Field of Search ..... 4/324, 378, 325, 415, 4/386, 397, 398-390, 391, 405, 413, 395

[56] References Cited

U.S. PATENT DOCUMENTS 1,149,494 8/1915 Briggs ..... 4/390
1,475,670 11/1923 Yorks ..... 4/390
1,667,990 5/1928 Rogers ..... 4/412
2,580,898 1/1952 Alzugaray ..... 4/324
4,293,964 10/1981 Riedel ..... 4/378

FOREIGN PATENT DOCUMENTS 2442306 6/1980 France ..... 4/378

*Primary Examiner*—Henry K. Artis
*Attorney, Agent, or Firm*—Arthur B. Colvin

[57] ABSTRACT

Toilet flush tanks run completely empty when the actuating device is actuated briefly. In very many cases this is not necessary. Therefore, a toilet flush tank is proposed where the drain closure part, actuated by a closing force, closes the drain. The closing force can either occur automatically after the water level has dropped accordingly, or it can be released manually when the water level is observed visually.

3 Claims, 7 Drawing Figures

TOILET FLUSH TANK

Figure 1:
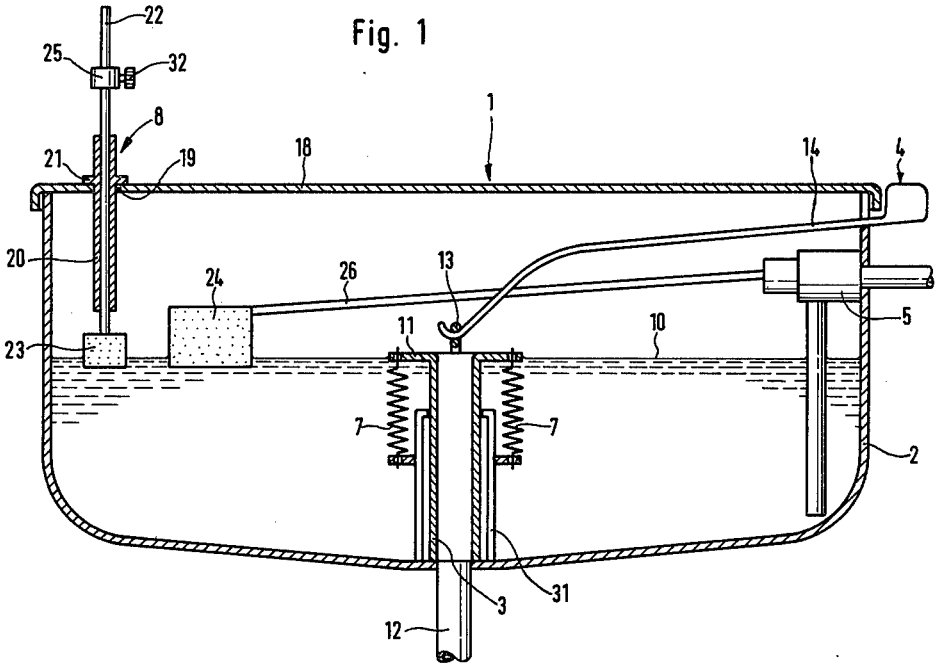

This invention relates to a toilet flush tank having a water reservoir, a drain closure part, and an actuating device for the drain closure part in operative connection therewith and also having a float-actuated water feed valve.

Toilet flush tanks of the above named kind are in general use. They have proved successful and operate reliably. Such toilet flush tanks have the disadvantage, however, that when the actuating device is actuated once briefly, they discharge their total volume of water. Release of the actuating device does not bring about an interruption of the evacuation. To flush down urine, however, does not require the total volume of water in the tank. An outflow of about 4 liters of water would suffice for clean water to be obtained again in the bowl. The water supply in the toilet flush tank in excess thereof is lost completely uselessly and therefore must be reprocessed to fresh water again quite unnecessarily. For a family of four, for example, daily about 140 liters of water are thereby consumed quite unnecessarily. At the same time, with this unnecessarily consumed water the capacity of the treatment plants is strained equally unnecessarily. Due to the large number of households using flush tanks, it is apparent that astronomical quantities of fresh water are consumed uselessly.

It is, therefore, the object of the invention to provide a toilet flush tank of the above described kind whereby this unnecessary water consumption can be avoided and thus considerable costs to the national economy can be saved.

According to one embodiment of the invention, the problem is solved in that the drain closure part is loaded by a spring-elastic structural element exerting a corresponding force, and that the tank is equipped with a water level indicator. The spring-elastic structural element provides that when the actuating device is no longer being actuated, the drain closure part immediately and reliably closes the drain of the water reservoir, thereby stopping any further outflow of water from the reservoir. The water level indicator makes it possible to see reliably when the quantity required for obtaining satisfactory level of water in the toilet bowl has run out so that the user may release the actuating device. It is thereby possible to avoid the above described unnecessary consumption of water.

In a variant of the invention it is proposed that in a toilet flush tank of the above described kind the drain closure part has a dead weight such that it reliably shuts off the stream of water flowing out after an actuation when the actuation ceases, the tank being equipped with a water level indicator also in this case. This variant makes possible an especially simple design of the toilet flush tank and yet fulfills the task set.

In a development of the invention it is proposed that the supplementary weight is arranged in the upper region of the drain closure part above the water level of the filled water reservoir. Thereby a simple retrofitting of existing tanks is made possible, a falsification of the force effect of the supplementary weight by water buoyancy being prevented.

According to a further development it is proposed that the supplementary weight has a mass of about 120 grams. Tests on existing toilet flush tanks have shown that the active force of this mass is sufficient to provide for a safe closing by the drain closure part when actuation ceases. The use of a greater mass is perfectly possible also, but makes actuation more difficult.

According to another development of the invention it is proposed that at least one spring-elastic structural element exerting a closing force on the drain closure part is fastened on the one hand to an attachment part arranged on the drain closure part and on the other hand to the tank or to structural elements connected therewith at least force-lockingly. Also by this measure the objective set is achieved and simultaneously a simple retrofitting of existing tanks made possible.

Again according to a development of the invention it is proposed that in toilet flush tanks where the drain closure part has at its upper end an upwardly and downwardly closed hoop into which protrudes an actuating arm of the actuating device, the end of the actuating arm protruding into the hoop is connected with a structural element acting as extension spring, the other end of this structural element being secured to the water reservoir or to structural elements connected with the latter at least form-lockingly. This, too, results in an especially simple retrofitting of existing tanks. But also in new production toilet flush tanks can be equipped in this manner without having to retool the production process in any appreciable extent.

In a further development of the invention it is proposed that the spring-elastic structural element or the structural element acting as extension spring is pretensioned in the closing position of the drain closure part to a pretension force of approximately 120 grams. Already with this pretension force a sure closing effect is attainable. A higher pretension force is, of course, usable, but makes actuation more difficult.

Again according to a development of the invention it is proposed that the water reservoir is transparent at least in a portion extending in perpendicular direction at least up to the water level of a desired partial filling level or has a transparent window of corresponding dimensions. In this manner the water level indicator can be integrated into the tank and thus the overall dimension kept small.

In a further development of the invention it is proposed that in those toilet flush tanks where the water reservoir is equipped with an upper covering, the upper covering has a bore in which a vertically arranged guide pipe is secured, and that a rod which protrudes on both sides beyond the guide pipe slides in the guide pipe, while the end of the rod protruding into the water reservoir is supported by a float and its outwardly projecting end has a stop. This is a water level indicator which permits an especially simple retrofitting of existing tanks. When the stop abuts on the guide pipe, the first partial quantity of water has been taken out and actuation of the actuating device can be interrupted if desired.

According to a further development of the invention it is proposed that the stop is arranged displaceable and fixable on the outwardly projecting end of the rod arranged in the guide pipe. In this way the water level indicator can be made adjustable for indication of different water quantities or be adjusted to different sizes of the water reservoirs.

In a variant, in those toilet flush tanks of the initially described kind where the float for the actuation of the water feed valve is disposed at the free end of an actuating lever, it is proposed that either at the actuating lever or at the upper end of the drain closure part, a boom or lever of such length is arranged that it can come into abutment on a counter-surface of the respective other structural part in the vertical direction, leaving between the boom and the counter-surface of the other structural part in vertical direction in the filled state of the water reservoir a distance which corresponds to a desired amount of drop of the water level, and the float having a mass such that at the water level of the desired lower filling level it exerts in consideration of the lever ratio via the boom onto the drain closing part a force of about 120 grams acting in vertical direction. With these measures a water level indicator can be economized and simultaneously the draining of the first portion of water be regulated so that the actuating device need not remain actuated during the entire outflow time. A brief actuation of the actuating device suffices to let the first partial amount flow out. If the toilet flush tank is to be evacuated completely, the actuating device must remain actuated during the entire outflow time. With the brief actuation as customary until now, therefore, only the adjusted partial amount and not the total volume of water is evacuated.

According to a further variant of the invention it is proposed that in toilet flush tanks of the initially described kind the drain closure part has approximately at the height of the desired low water level a float element whose mass force corresponds at least approximately to its buoyant force and is not less than 110 grams. Thereby an especially simple and compact design is achieved, and again a water level indicator can be dispensed with. Here, too, it is achieved that with a brief actuation of the actuating device only the first portion of water flows out and thereafter the flush tank is reliably closed. Besides, by this conception both retrofitting and new production is made possible in an extremely simple manner.

In the accompanying drawings in which are shown one or more of various possible embodiments of the several features of the invention.

Figure 4:
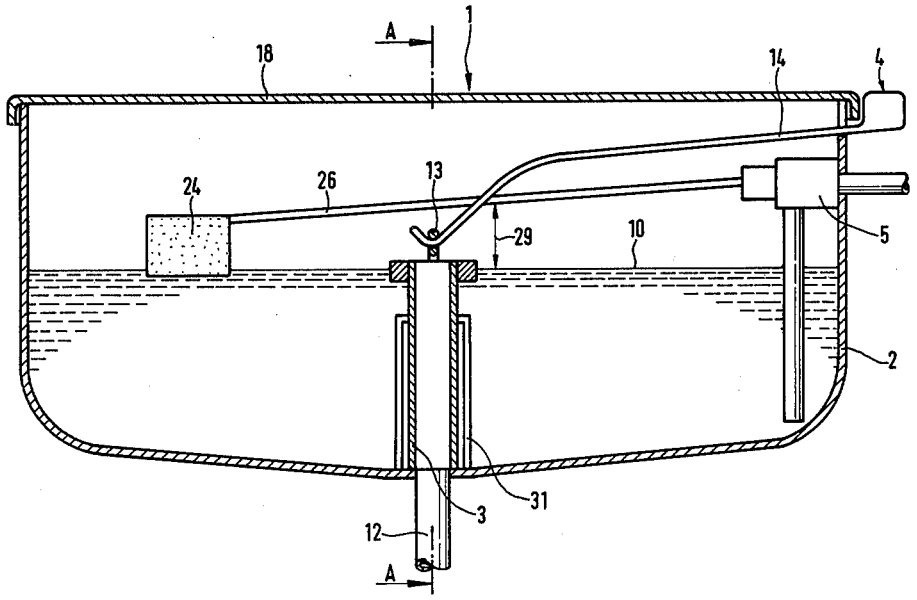
Figure 5:
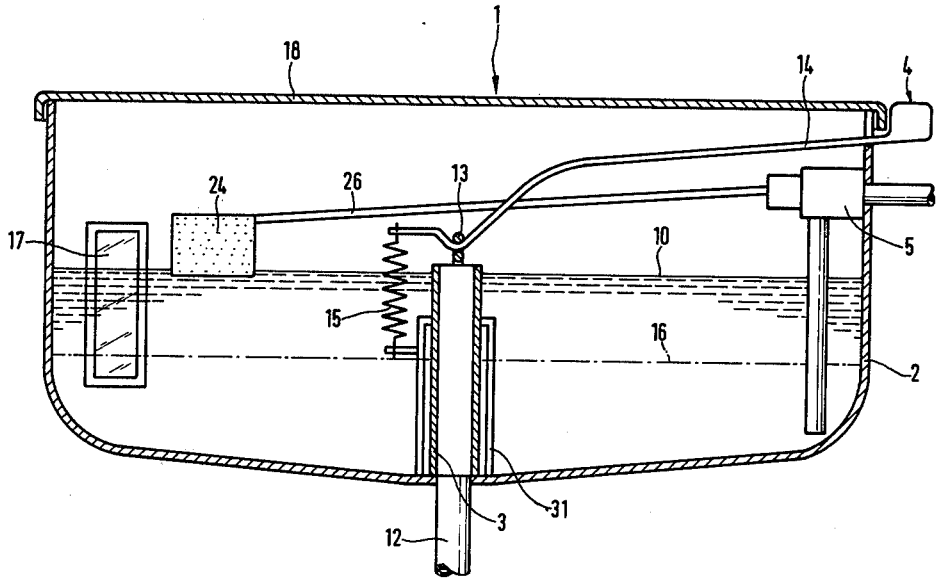
Figure 6:
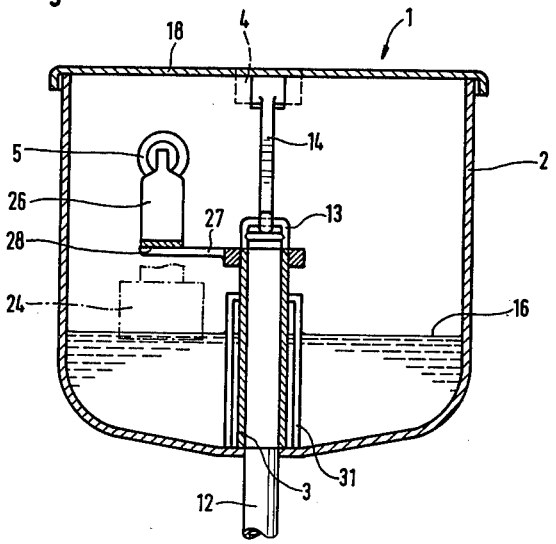

FIGS. 1 to 5 and FIG. 7, shown different forms of the toilet flush tank according to the invention, and FIG. 6 is a section A—A according to FIG. 4.

Referring now to the drawings, FIG. 1 shows a toilet flush tank 1 where the water reservoir 2 is covered by an upper covering 18. In the interior of the water reservoir a water feed valve 5 is arranged, which depending on the water level, can be opened or closed in known and customary manner via a float 24 and an actuating lever 26 connected with the float 24. If, for example, a water level 10 has been reached, the water feed valve 5 is closed. If in such a toilet flush tank the actuating device 4 is actuated, the drain closure part 3 is thereby lifted via the actuating lever 14, and the water can blow out through the drain pipe 12. The drain closure part 3 is positioned in a pervious guide device 31 and comprises at its upper end an attachment part 11–13. On this attachment part 11 spring-elastic structural elements 7 are fastened, which by their other end are fastened to the guide device 31. These spring-elastic structural elements 7 are to act as extension springs in the embodiment and thus always exert a closing force on the drain closure part. To open the drain, this closing force must be overcome by the actuating device 4. The forces here involved however, are not great. In the conventional toilet flush tanks a closing force of about 120 grams is sufficient.

The upper covering 18 of the toilet flush tank has a bore 19, in which is secured a vertically arranged guide pipe 20 by means of a flange 21. In this guide pipe 20 slides a rod 22 which protrudes on both sides beyond the guide pipe. On the part of the rod 22 projecting upwardly from the guide pipe a displaceable stop 25 is disposed, which can be fixed in a selected position via the clamping screw 32. The other end of rod 22 is carried by a float 23. Just as well the rod 22 may take support on the float 24. In that case simply a different adjustment of the stop 25 would have to be chosen. Float 23 may alternatively be omitted.

Guide pipe 20, rod 22, and the associated structural parts are used as a water level indicator 8. When the actuating device 4 is actuated, the water flows out through the drain pipe 12, and the water level 10 and hence the float 23 and the float 24 drop. With float 23 also rod 22 and stop 25 descend in the embodiment shown. The stop 25 is adjusted so that when float 23 has descended to the desired water level, stop 25 rests on the upper end of the guide pipe 20. If only the first portion of the total water volume is needed, the actuating device must now be manually released. As a result the spring-elastic structural elements 7 immediately again tightly closes the drain closure part 3. Since the float 24 has descended as well, the water feed valve 5 has been opened via the actuating lever 26. New water now flows in the usual and known manner until the water level 10 has again been reached. Instead of the water level indicator 8, it is of course also possible to observe the water level by means of a transparent window 17 (FIG. 5). The transparent window 17 is arranged so that its lower edge forms a mark for the water level after evacuation of the partial volume.

Figure 2:
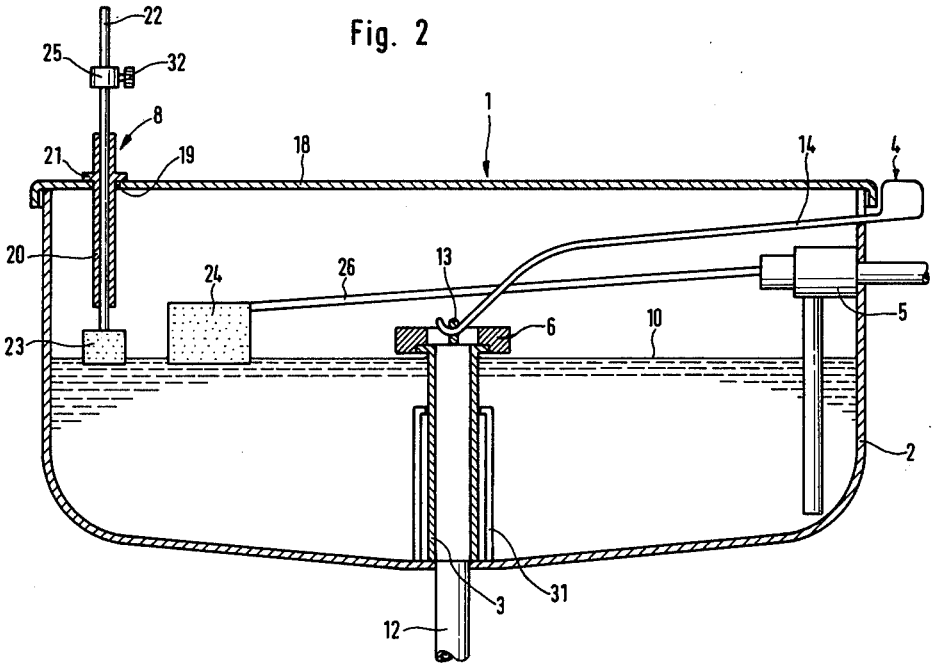
Figure 3:
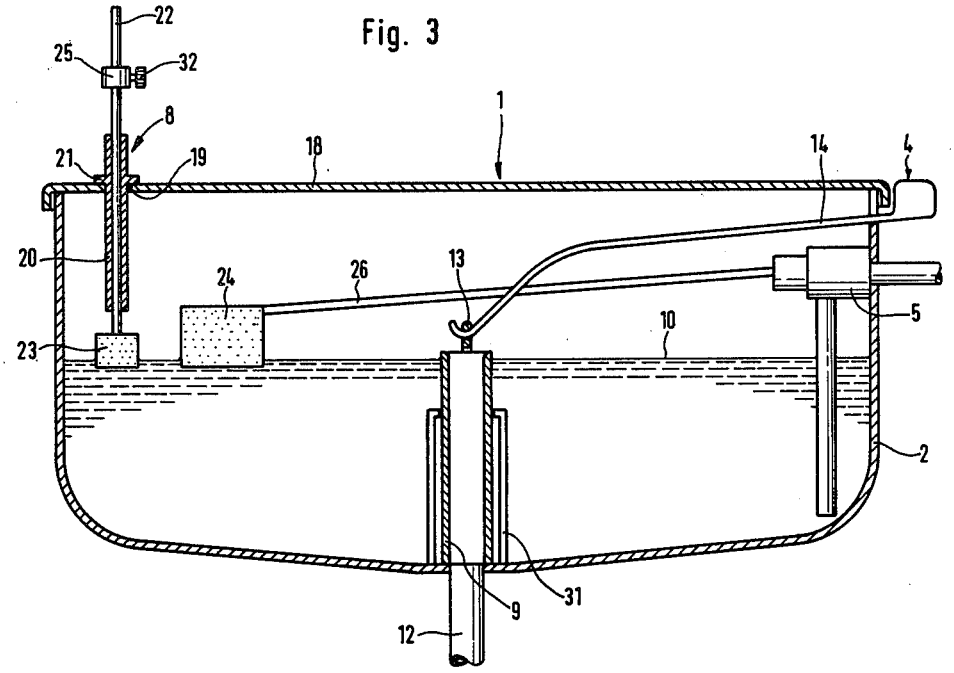

A toilet flush tank according to FIG. 2 is similar to the one shown in FIG. 1. Here, however, the spring-elastic structural elements 7 have been omitted and the attachment part 11 has been replaced by a supplementary weight 6. The supplementary weight 6, which is arranged so that it is always above the water level, exerts a constant closing force on the drain closure part 3, so that the described effect is obtained.

A constant closing force acting on the drain closure part 3 can, of course, be obtained also by making this drain closure part itself heavy enough. In the embodiment according to FIG. 3 a drain closure part 9 has been provided which is made of a material of suitable weight. Here, of course, one must see to it that the function of the drain closure part as overflow pipe is not impeded.

FIG. 5 shows an embodiment of the toilet flush tank of the invention where on the inwardly protruding end of the actuating arm 14 a structural element 15 acting as extension spring is fastened, which by the other end is fastened to the guide device 31, which in turn is connected with the water reservoir 2. Said end of the actuating arm 14 is guided through an upwardly and downwardly closed hoop 13 of the drain closure part 3. The structural element 15 acting as extension spring always pulls the actuating arm 14 downward and thus exerts via the hoop 13 a closing force on the drain closure part 3.

Figure 7:
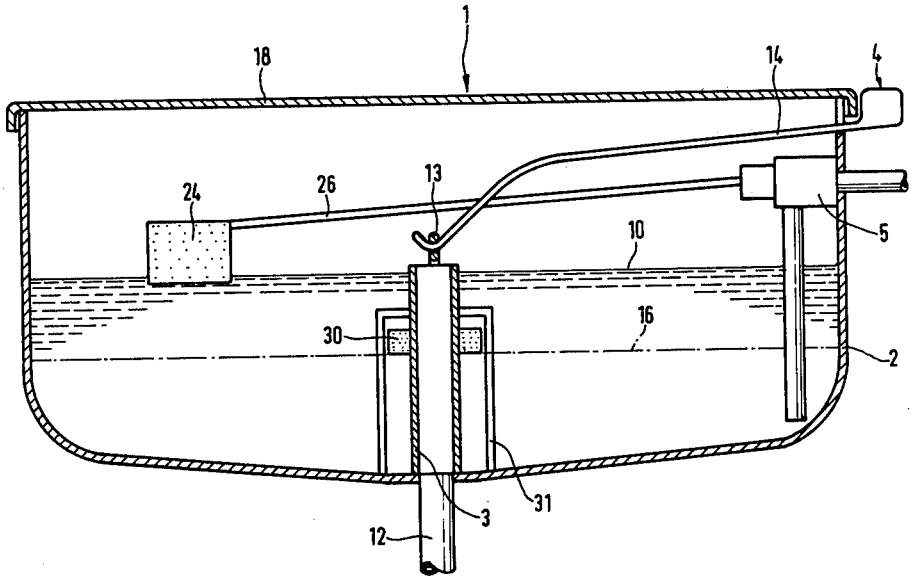

Toilet flush tanks of the forms according to FIGS. 4, 6 and 7 can do entirely without a water level indicator. In the embodiment according to FIGS. 4 and 6, the drain closure part 3 is equipped at its upper end with an arm 27 which, when the water reservoir 2 is filled, has a distance 29 from the actuating lever 26 in vertical direction and which, as the water level sinks to the partial filling level 16, will be abutted by a counter-surface 28 of the actuating lever 26. In this way the weight of the descending float 24 presses on the drain closure part and thus exerts a closing force on it. With this arrangement, the actuating device 4 need not remain actuated for the evacuation of the first partial volume, but must only be actuated briefly in the manner as customary heretofore. It may be let go again immediately after the brief actuation. After release, the water drains nevertheless as usual until the water level has dropped to the partial filling level 16. At that moment, further draining stops automatically, as described. If the total volume of water is to be evacuated, the actuating device 4 must remain actuated. It is thus not possible to use up water unnecessarily through thoughtlessness.

The embodiment according to FIG. 7 permits handling as has been described in connection with FIGS. 4 and 6. Here, however, the cost of construction has been further reduced. The drain closure part simply comprises, approximately at the height of the partial filling level 16, a float element 30, whose mass force corresponds at least approximately to its buoyant force and is not less than 110 grams. In this manner, when the water reservoir 2 is filled (water level 10), the float element 30 exerts no force on the drain closure part 3. Now if, as usual, the actuating device 4 is actuated briefly, the water flows out unhindered through the drain pipe 12 until the water level has dropped to the extent that the float element 30 rises to the surface. Now the mass force of the float element 30 is no longer compensated by the buoyant force of the water, so that now the float element 30 can exert a closing after the outflow of the desired partial volume, that is, after the water level has dropped to the partial filling level 16. Again a mindless extra consumption of water is thus not possible. Complete evacuation of the water reservoir 2 must be brought about deliberately by actuation of the actuating device 4.

Having thus described my invention, what I claim as new and desire to secure by Letters Patent of the United States is:

1. A toilet flush tank apparatus having a water reservoir, said apparatus being selectively actuable to fully empty said reservoir or to automatically interrupt emptying of said reservoir at an intermediate level, a float activated water feed valve in said reservoir, a drain closure part, movable means reacting against said closure part in the filled condition of said reservoir to close the latter, an actuator device to shift said movable means away from said closure part, said actuator device being shiftable between first and second positions, said actuator device in its first position releasing said movable means and in said second position lifting said movable means clear of said drain part, the combination including automatic means for returning said movable means to closing position of said drain when said actuator device is shifted from said first to said second position and thereafter released to said first position, said automatic means being responsive to the water level in said tank reaching an intermediate level between full and empty to effect said return movement to said movable means.

2. Apparatus in accordance with claim 1 wherein said automatic means comprises a float secured to said movable means, said float having a mass at least equal to its buoyant force when submerged, said float being secured to said movable means at a level above the lowermost level of said reservoir and below the filled level of said reservoir when said movable means is seated against said closure part, the combined weight of said movable means and said float being sufficient to shift said movable means into closing relation of said drain closure part when the water level in said reservoir falls below the level of said float, but being insufficient to shift said movable means into reclosing relation of said drain part after said movable means has been lifted clear of said drain part while said water level is above the level of said float.

3. Apparatus in accordance with claim 1 wherein said automatic means comprises a lever on said water feed means, and an abutment on said movable means, said lever being positioned to engage and depress said abutment when said water reaches said intermediate level to thereby depress said movable means into closing relation of said drain part.

* * * * *